US009540853B2

(12) United States Patent
Pickar et al.

(10) Patent No.: US 9,540,853 B2
(45) Date of Patent: Jan. 10, 2017

(54) INTEGRATED HANDLE AND LATCH ASSEMBLY FOR RV SCREEN AND ENTRY DOORS

(71) Applicant: Trimark Corporation, New Hampton, IA (US)

(72) Inventors: Barbara J. Pickar, New Hampton, IA (US); Mark L. Smith, Buchanan, MI (US)

(73) Assignee: TriMark Corporation, New Hampton, IA (US)

( * ) Notice: Subject to any disclaimer, the term of this patent is extended or adjusted under 35 U.S.C. 154(b) by 162 days.

(21) Appl. No.: 13/939,659

(22) Filed: Jul. 11, 2013

(65) Prior Publication Data

US 2014/0015260 A1 Jan. 16, 2014

Related U.S. Application Data

(60) Provisional application No. 61/670,435, filed on Jul. 11, 2012.

(51) Int. Cl.
*E05B 3/00* (2006.01)
*E05B 83/44* (2014.01)
(Continued)

(52) U.S. Cl.
CPC ..... *E05B 83/44* (2013.01); *E05B 63/143* (2013.01); *E05C 1/14* (2013.01); *E05C 7/02* (2013.01); *Y10T 292/0968* (2015.04)

(58) Field of Classification Search
CPC ..... E05B 83/44; E05B 63/14; E05B 63/143; E05B 63/16; E05B 65/0003; E05C 7/00; E05C 7/02; E05C 7/002; E05C 1/14
(Continued)

(56) References Cited

U.S. PATENT DOCUMENTS 1,186,263 A * 6/1916 Agee ..... E06B 3/7009 160/96
2,219,344 A * 10/1940 Taylor ..... E05D 11/105 16/324
(Continued)

FOREIGN PATENT DOCUMENTS

DE 425468 C * 2/1926 ..... E05C 7/02
DE 465865 C * 9/1928 ..... E05C 7/02

OTHER PUBLICATIONS

Computer Generated Translation for DE 465865, http://worldwide.espacenet.com, translated on Dec. 21, 2015.*
(Continued)

*Primary Examiner* — Alyson M Merlino
(74) *Attorney, Agent, or Firm* — McKee, Voorhees & Sease, PLC

(57) ABSTRACT

A handle assembly is provided for a dual main door and screen door assembly of an RV or trailer. The assembly includes a main door module and a screen door module. The main door module includes an outside handle which retracts the main door plunger when the doors are both closed. The screen door module includes an inside handle which retracts the main door plunger from inside the RV or trailer when both doors are closed. The inside handle also retracts the screen door plunger when from inside the RV or trailer when the screen door is closed and the main door is open. An outside handle on the screen door module retracts the screen door plunger from the outside when the main door is open and the screen door is closed.

10 Claims, 15 Drawing Sheets

(51) Int. Cl.

| | |
|---|---|
| ***E05B 63/14*** | (2006.01) |
| ***E05C 1/14*** | (2006.01) |
| ***E05C 7/02*** | (2006.01) |
| *E05C 3/12* | (2006.01) |

(58) Field of Classification Search

USPC ..... 292/2, 3, 32–34, 40, DIG. 21, 137, 156, 292/161, 162, 336.3, DIG. 31, DIG. 35, 292/DIG. 27, DIG. 65, 173; 49/61–65, 67, 49/163, 168, 169, 170, 171, 52, 54; 70/DIG. 65, DIG. 80, 91, 101, 104, 106, 70/107, 109, 111, 124, 129, 134, 141, 70/144, 145, 208, 370, 371, 379 R, 467, 70/110, 130, 210; 296/1.02, 156, 164, 296/168; 160/90, 92, 96

See application file for complete search history.

(56) References Cited

U.S. PATENT DOCUMENTS

| | | | | | |
|---|---|---|---|---|---|
| 2,381,666 | A * | 8/1945 | Hinton et al. | ..... | 160/95 |
| 2,427,386 | A * | 9/1947 | Claud-Mantle | ..... | E05B 85/22 292/169.11 |
| 2,537,896 | A * | 1/1951 | Hinton et al. | ..... | 292/1 |
| 3,722,237 | A * | 3/1973 | Taylor | ..... | 70/107 |
| 4,302,907 | A * | 12/1981 | Canals et al. | ..... | 49/65 |
| 4,470,276 | A * | 9/1984 | Bayless | ..... | 70/91 |
| 4,767,139 | A | 8/1988 | Hansing | | |
| 5,474,345 | A | 12/1995 | Clark et al. | | |
| 5,535,550 | A | 7/1996 | Yang | | |
| 5,927,773 | A | 7/1999 | Larsen et al. | | |
| D419,421 | S | 1/2000 | Larsen et al. | | |
| 6,009,932 | A | 1/2000 | Smith | | |
| 6,409,234 | B1 | 6/2002 | Larsen et al. | | |
| 6,941,997 | B2 * | 9/2005 | Butler | ..... | 160/92 |
| 7,448,668 | B2 | 11/2008 | Brabeck et al. | | |

OTHER PUBLICATIONS

TriMark Corporation Product Brochure, "060-0201 Trailer Latch 060-0251 with Deadbolt", ISO 9001:2008, ISO/TS 16949:2009, 03/11-8, 4 pages.

* cited by examiner

INTEGRATED HANDLE AND LATCH ASSEMBLY FOR RV SCREEN AND ENTRY DOORS

CROSS-REFERENCE TO RELATED APPLICATIONS

This application claims priority under 35 U.S.C. §119 to provisional application Ser. No. 61/670,435 filed Jul. 11, 2012, herein incorporated by reference in its entirety.

BACKGROUND OF THE INVENTION

Recreational Vehicle motor homes and camping trailers typically have an entrance with a primary door and a screen door which can be opened together or independently of one another. The main door provides security and safety for occupants, while the lightweight screen door provides airflow and restricts insects from entering the RV or trailer. Both doors are pivotally hinged for movement between open and closed positions relative to the entrance opening of the RV or trailer. The screen door can be attached to the main door so that the doors move together, or alternatively, can be detached from the main door so that the main door can be held open while the screen door is held closed.

In this conventional dual door assembly, the main door has an exterior handle for opening the door from outside the RV and an interior handle for opening the door from inside the RV. U.S. Pat. Nos. 5,927,773 and 6,409,234 which are owned by the assignee, discloses a paddle operated latch mechanism for the main RV doors. However, when the main door is closed, the screen door covers the inside handle of the main door, with access to the inside handle being provided by a sliding panel on the screen door. The screen door typically has a separate handle on the outside of the screen door for releasing the screen door latch. The screen door handle is normally accessed from the inside of the door by opening the sliding panel on the screen door and reaching through the screen door. U.S. Pat. No. 6,009,932 discloses an RV screen door with a handle on the inside of the door.

Also on existing systems, a person inside the RV or trailer must slide the screen door panel to lock/unlock the deadbolt of the door because the lock knob is on the inside handle assembly of the main door.

The sliding screen door panel creates complexity, difficulty, and awkwardness in reaching the inside handle of the main door and the screen door handle from inside the RV or trailer. Also, the requirement for two separate handles on the main door and the screen door adds additional costs to the RV or trailer.

Therefore, a primary objective of the present invention is the provision of an improved handle assembly for a dual door assembly of an RV or trailer.

Another objective of the present invention is the provision of an integrated handle assembly for the main and screen doors of an RV or trailer.

A further objective of the present invention is the provision of an integrated handle assembly for an RV main door and screen door which eliminates the sliding panel on the screen door.

Still another objective of the present invention is the provision of a handle assembly for the main and screen doors of an RV or trailer which eliminates the need to reach through the screen door to open the main door from inside the RV or trailer.

Yet another objective of the present invention is an RV or trailer handle assembly which eliminates the need to reach through the screen door to lock/unlock the deadbolt in the main door from inside the RV or trailer.

Another objective of the present invention is the provision of an integrated handle assembly for the main and screen doors of an RV and trailer wherein the handle assembly has an exterior handle for opening both the main door and the screen door from outside the RV or trailer when both doors are shut, an interior handle for opening both doors from inside the RV or trailer when both doors are shut and for opening the screen door from inside the RV or trailer when the main door is open and the screen door is shut, and an intermediate handle for opening the screen door from outside the RV when the main door is open and the screen door is shut.

Yet another objective of the present invention is the provision of an integrated handle assembly with a main door and screen door of an RV or trailer which is economical to manufacture, and durable and safe in use.

These and other objectives will become apparent from the following description of the invention.

DETAILED DESCRIPTION OF THE DRAWINGS

Figure 1:
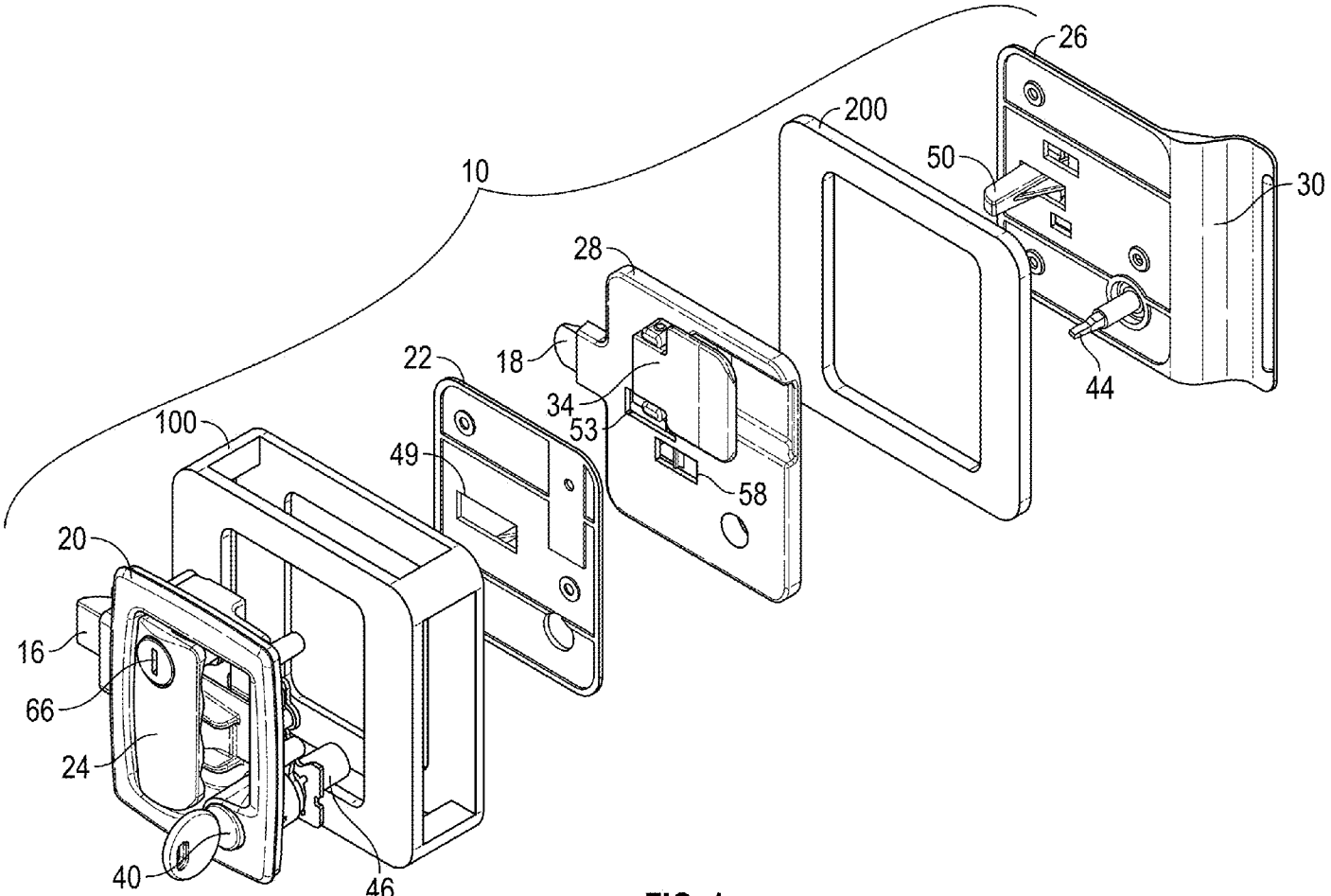
FIG. 1 is an exploded view of the integrated handle assembly of the present invention for use with the main door and screen door of an RV or trailer.
Figure 2:
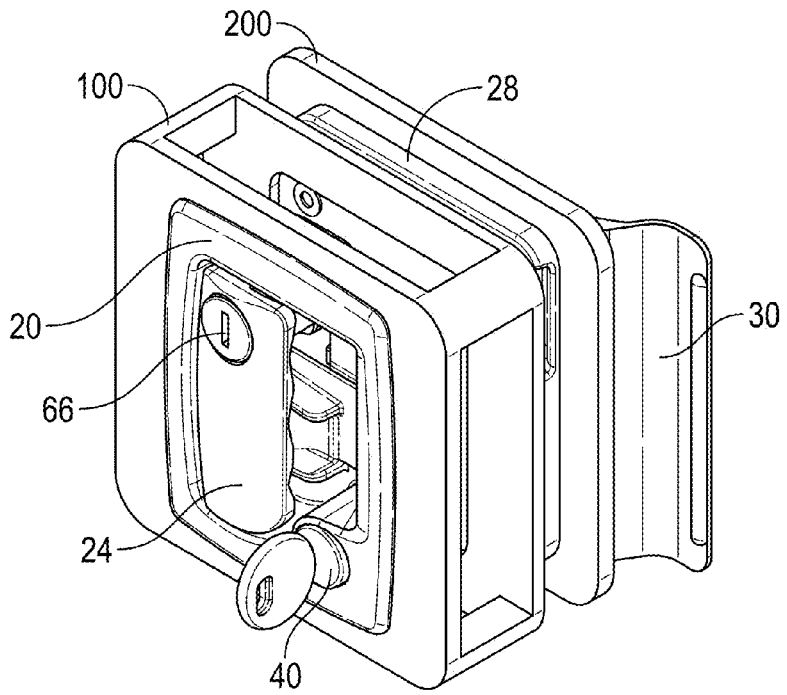
FIG. 2 is a perspective view of the integrated handle assembly from the exterior of the RV or trailer.
Figure 3:
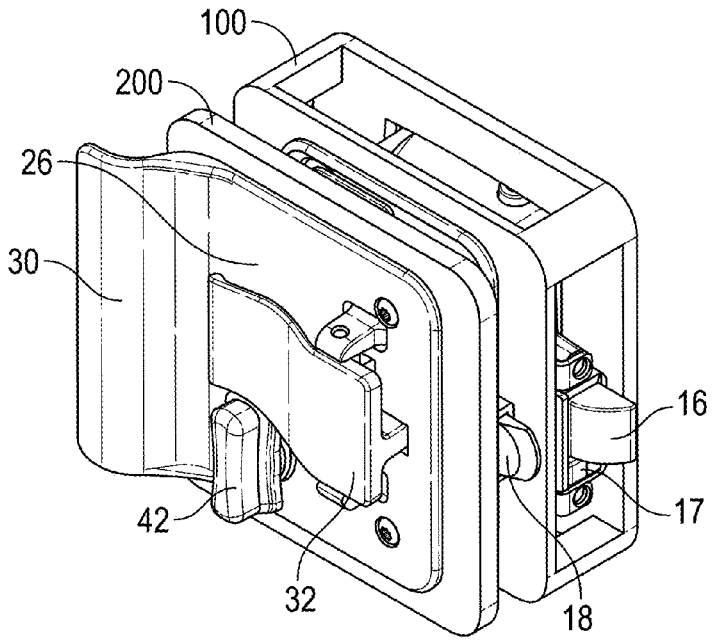
FIG. 3 is a perspective view of the integrated handle assembly from inside the trailer or RV.
Figure 4:
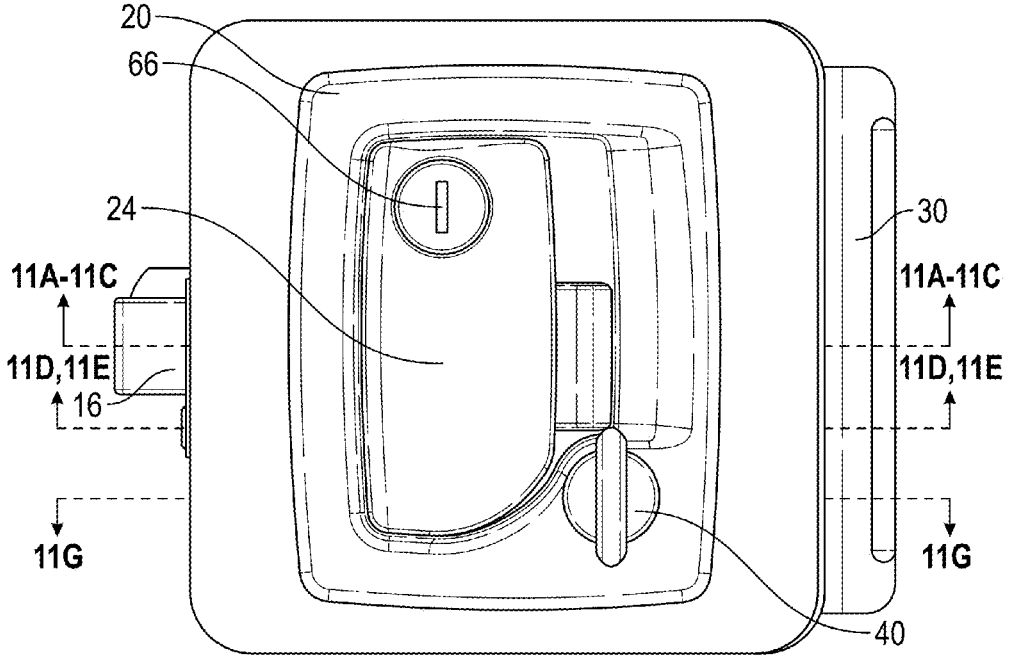
FIG. 4 is an exterior elevation view of the integrated handle assembly.
Figure 5:
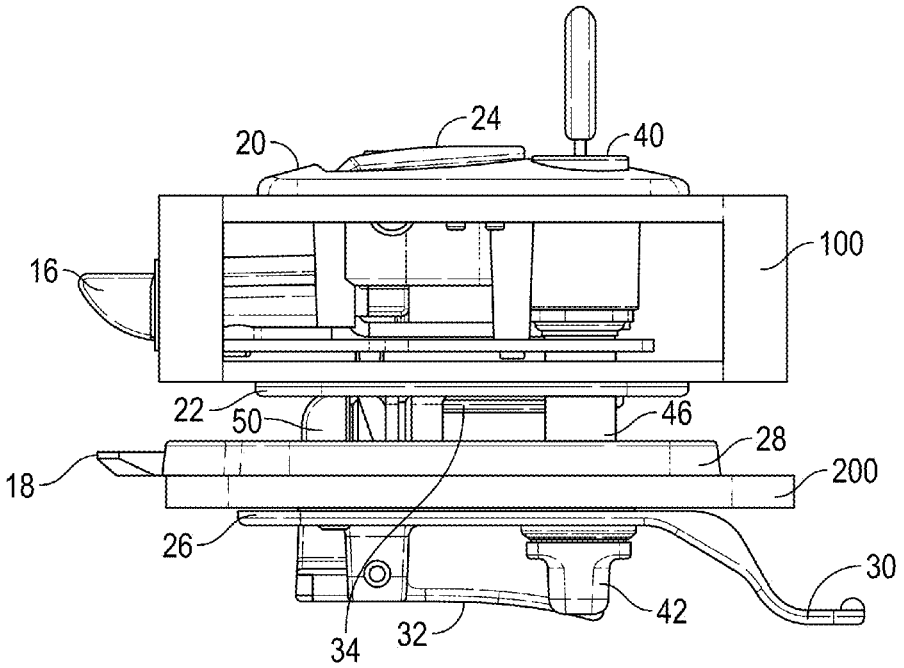
FIG. 5 is a bottom plan view of the integrated handle assembly.
Figure 6:
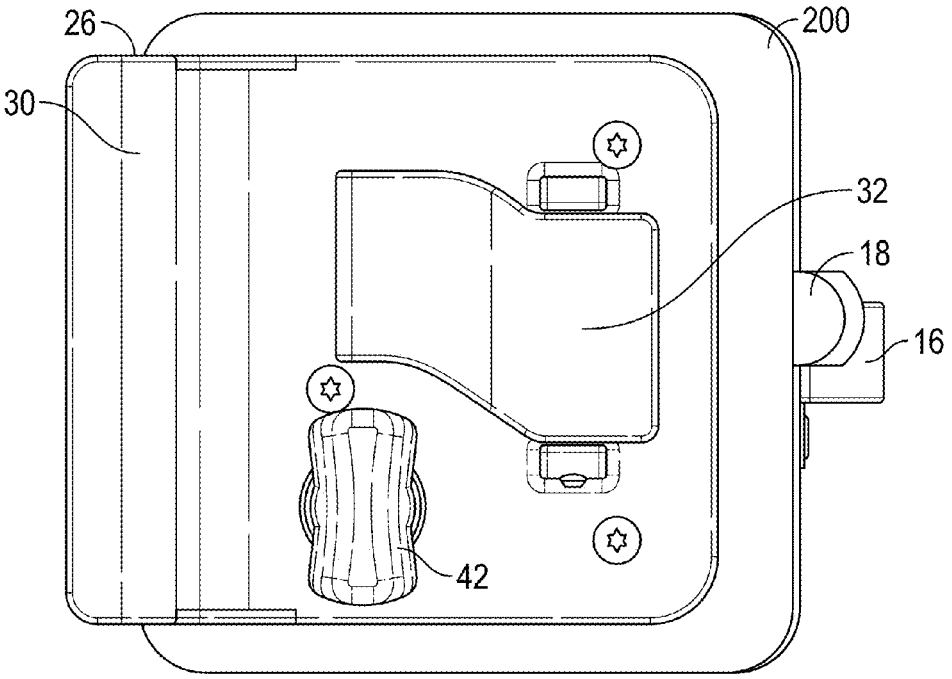
FIG. 6 is an interior elevation view of the integrated handle assembly.
Figure 7:
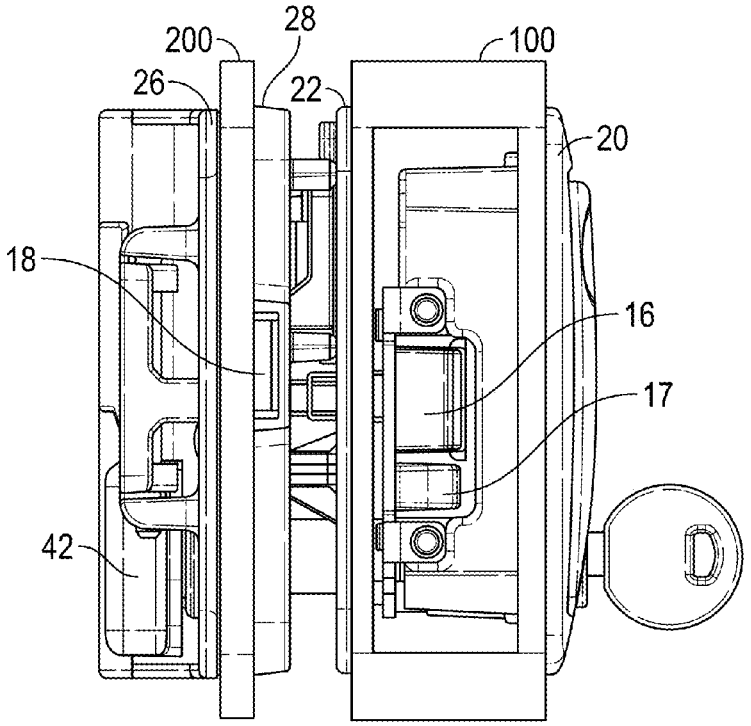
FIGS. 7 and 8 are elevation views from opposite ends of the integrated handle assembly.
Figure 8:
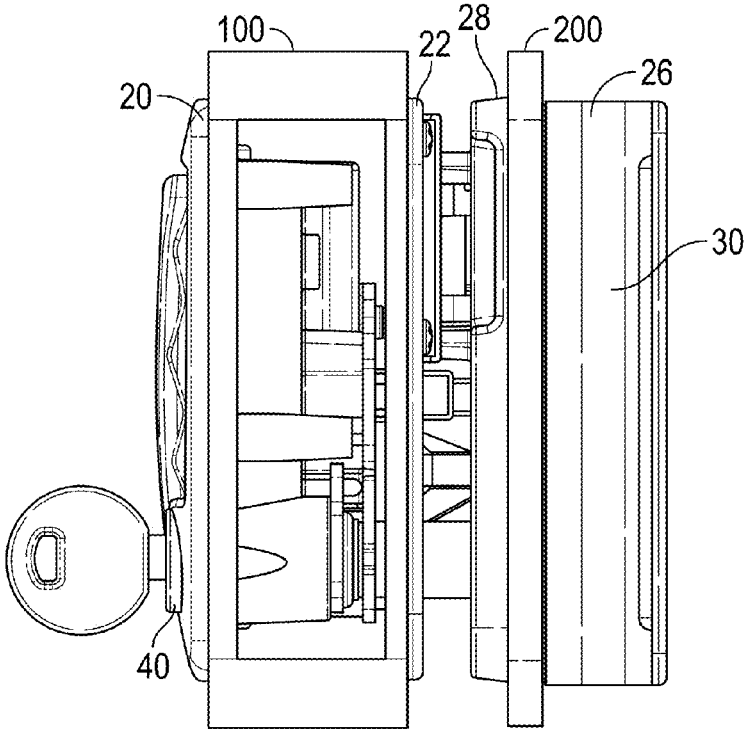
Figure 9:
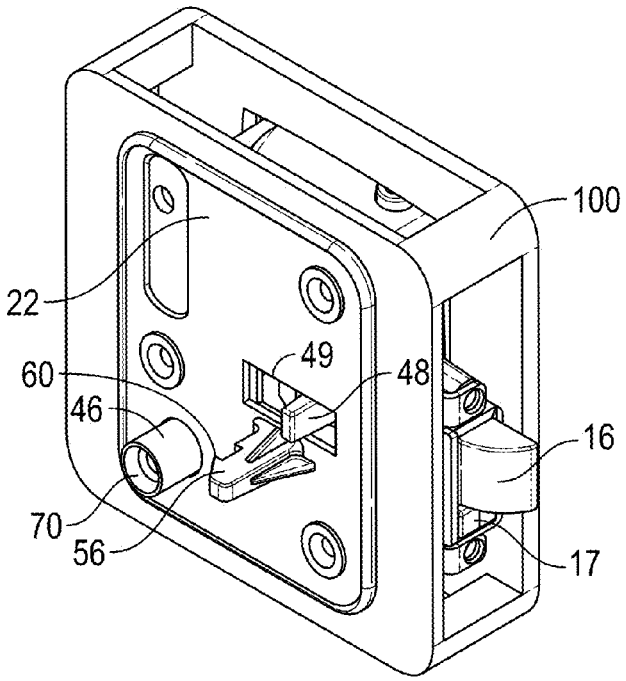
FIG. 9 is a perspective view of the main door module of the integrated handle assembly from the inside face of the module.
Figure 10:
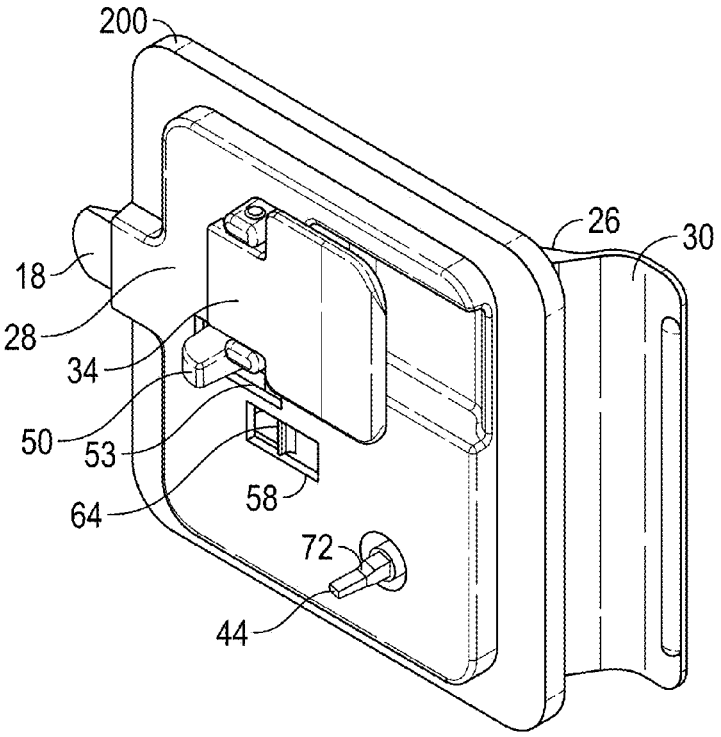
FIG. 10 is a perspective view of the screen door module of the integrated handle assembly from the outside face of the module.

An integrated handle assembly 10 is provided for use on an RV or trailer having a main entrance door 100 and a screen door 200. In the drawings, only a small portion of the doors 100, 200 are shown, rather than the entire door. The main and screen doors 100, 200 are conventional, and are pivotally mounted to the RV or trailer entrance opening so that the doors can be opened and closed together or independently of one another. The integrated handle assembly 10 includes a main door module 12 mounted on the main door 100 and a screen door module 14 mounted on the screen door 200. When the main door and screen door are coupled together for movement in unison, the handle modules 12, 14 are also coupled together.

Each handle module 12, 14 include a retractable plunger 16, 18, respectively. Each plunger 16, 18 is moveable between an extended position to engage a portion of the frame of the RV or trailer entrance opening and thereby retain the door 100, 200 in a closed position, and a retracted position to release the door 100, 200 for opening away from the entrance frame. The main door module 12 also has an extensible and retractable deadbolt 17.

Figure 11A:
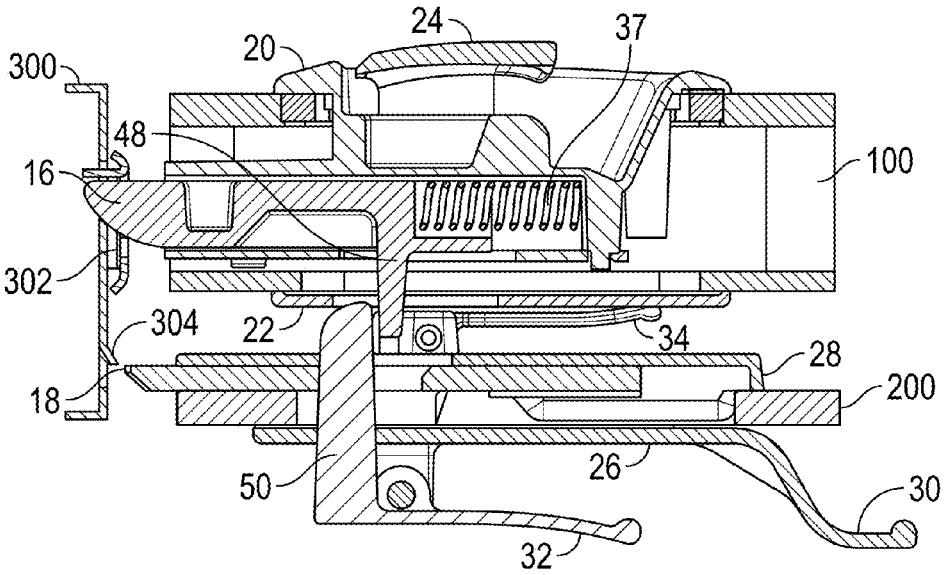
FIG. 11A is a sectional view of the integrated handle assembly taken along lines 11A-11A of FIG. 4.
Figure 11B:
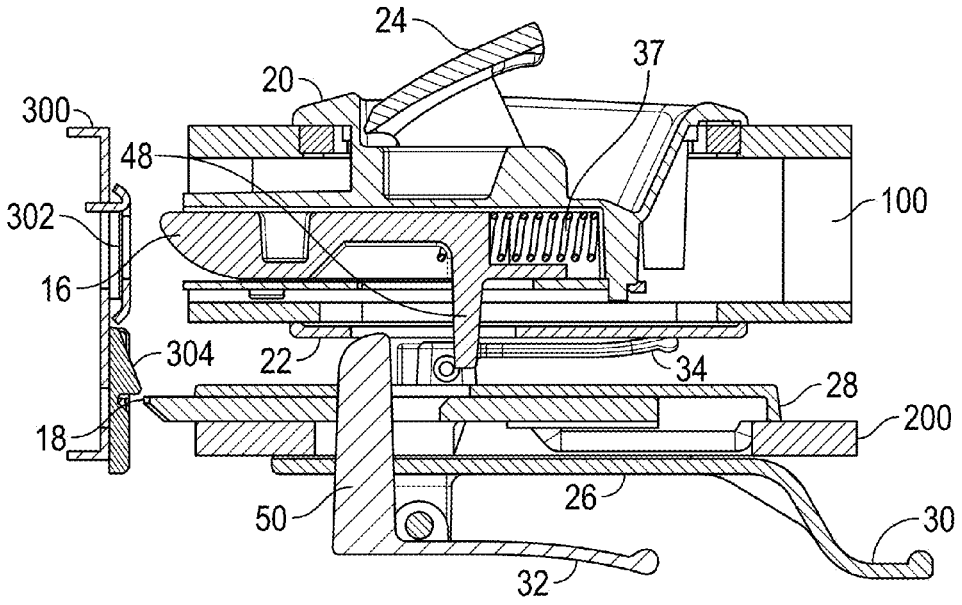
FIG. 11B is a sectional view similar to FIG. 11A showing the outside handle pulled to retract the main door plunger.

The main door module 12 has opposing handle assembly and cover plate 20, 22 between which the main door 100 is sandwiched. An exterior handle 24 is pivotally mounted on the main door handle assembly 20. The handle 24 is biased to a neutral or rest position. When the main door 100 and screen door 200 are coupled together and closed, the screen door plunger 18 is partially retracted and clear of the screen door frame 300 and a tab 304 on the door frame. The exterior handle 24 can be pulled to retract the main door plunger 16, from the door frame 300 and striker plate 302, as shown in FIG. 11B, so that the doors can be opened simultaneously to permit entrance into the RV or trailer.

Figure 11C:
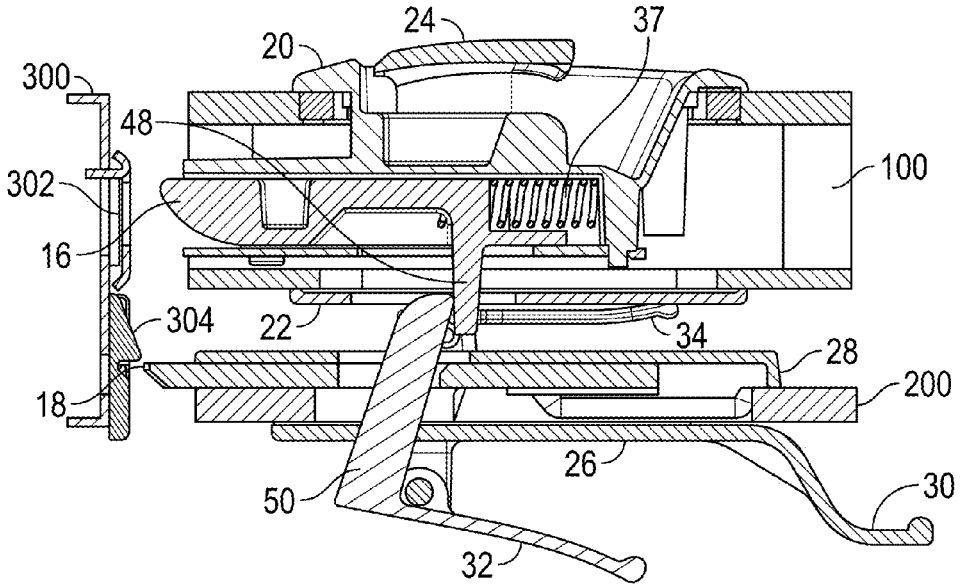
FIG. 11C is a view similar to FIG. 11A showing the interior screen door handle pulled to retract the plungers.

The screen door module 14 has opposing handle assemblies 26, 28 between which the screen door 200 is sandwiched. The screen door module 14 includes a finger grip 30 which allows the screen door module 14 to be pulled closed from inside the RV or trailer, independently or together with the main door 12. The screen door module 14 also includes an interior pivotal handle 32 on the inside of the module and an exterior pivotal handle 34 on the outside of the module. The handles 32, 34 are biased to a neutral or rest position. When the main door 100 is open and the screen door 200 is closed, the exterior screen door handle 34 can be pulled by a person standing outside the RV or trailer to retract the screen door plunger 18 and thereby open the screen door 200. When the screen door 200 is closed and the main door 100 is open, the interior screen door handle 32 can be pulled by a person inside the RV or trailer so as to retract the screen door plunger 18, and thereby open the screen door 200. Also, when the screen door 200 and main door 100 are coupled together and closed, the handle modules 12, 14 are also coupled together with the screen door plunger 18 partially retracted, clear of the screen door frame 300 and tab 304, so that actuation of the interior screen door handle 32 retracts the main door plunger 16 from the frame 300 and striker plate 302, to allow both doors to be opened simultaneously from inside the RV or trailer, as shown in FIG. 11C.

Figure 15:
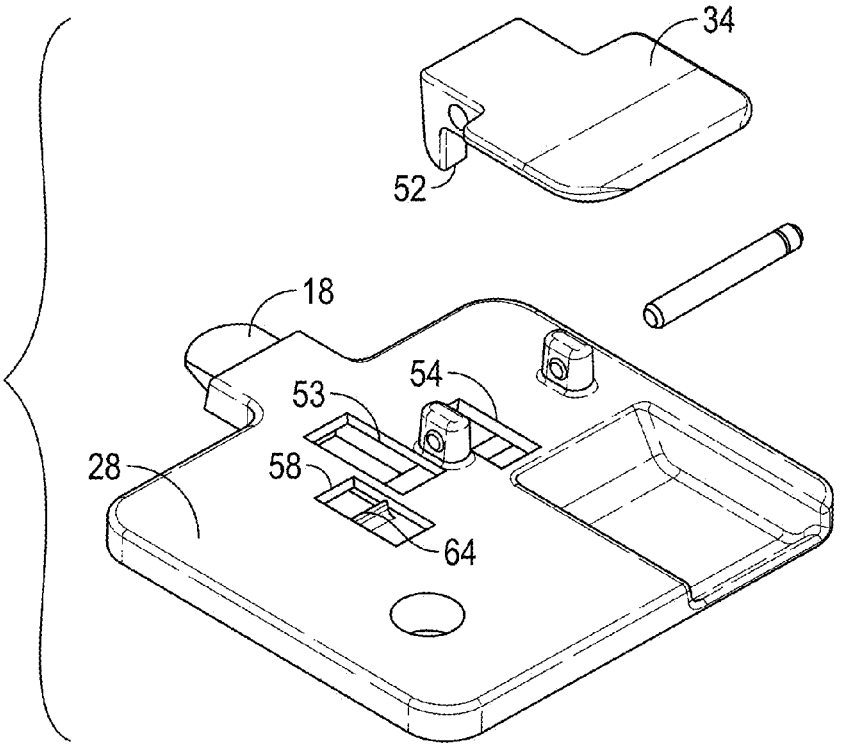
FIG. 15 is an exploded perspective view of the exterior handle assembly of the screen door module.

More particularly, when both doors 100, 200 are closed such that the modules 12, 14 are coupled and the interior screen door handle 32 is pulled, a leg 50 on the screen door module 14 engages a leg or post 48 on the main door plunger 16 to retract the main door plunger 16. The post 48 extends through a clearance hole 49 in the main door cover plate 22 of the main door module 12 and the leg 50 extends through a clearance hole 51 in the screen door inside handle assembly 26 of the screen door module 14, through a clearance hole 53 in the screen door exterior handle assembly 28 of the screen door module 14 and through a clearance hole 55 in the screen door plunger 18 (FIGS. 15-17), such that the legs 48 and 50 engage one another.

Figure 16:
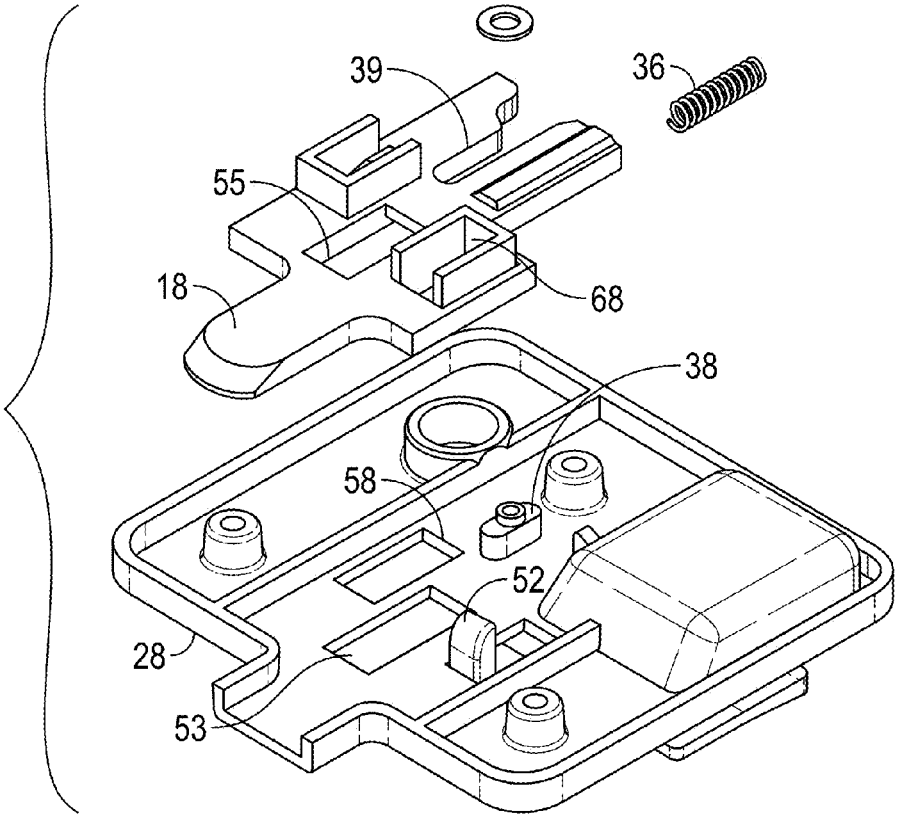
FIG. 16 is another exploded perspective view of the exterior handle assembly of the screen door module from the opposite side of FIG. 15.
Figure 17:
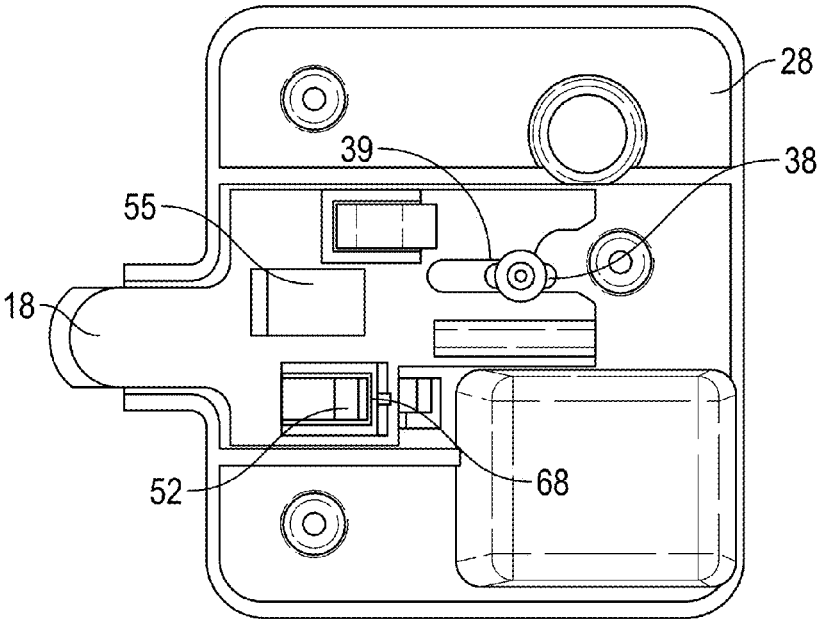
FIG. 17 is an elevation view of the exterior handle assembly of the screen door module.
Figure 18:
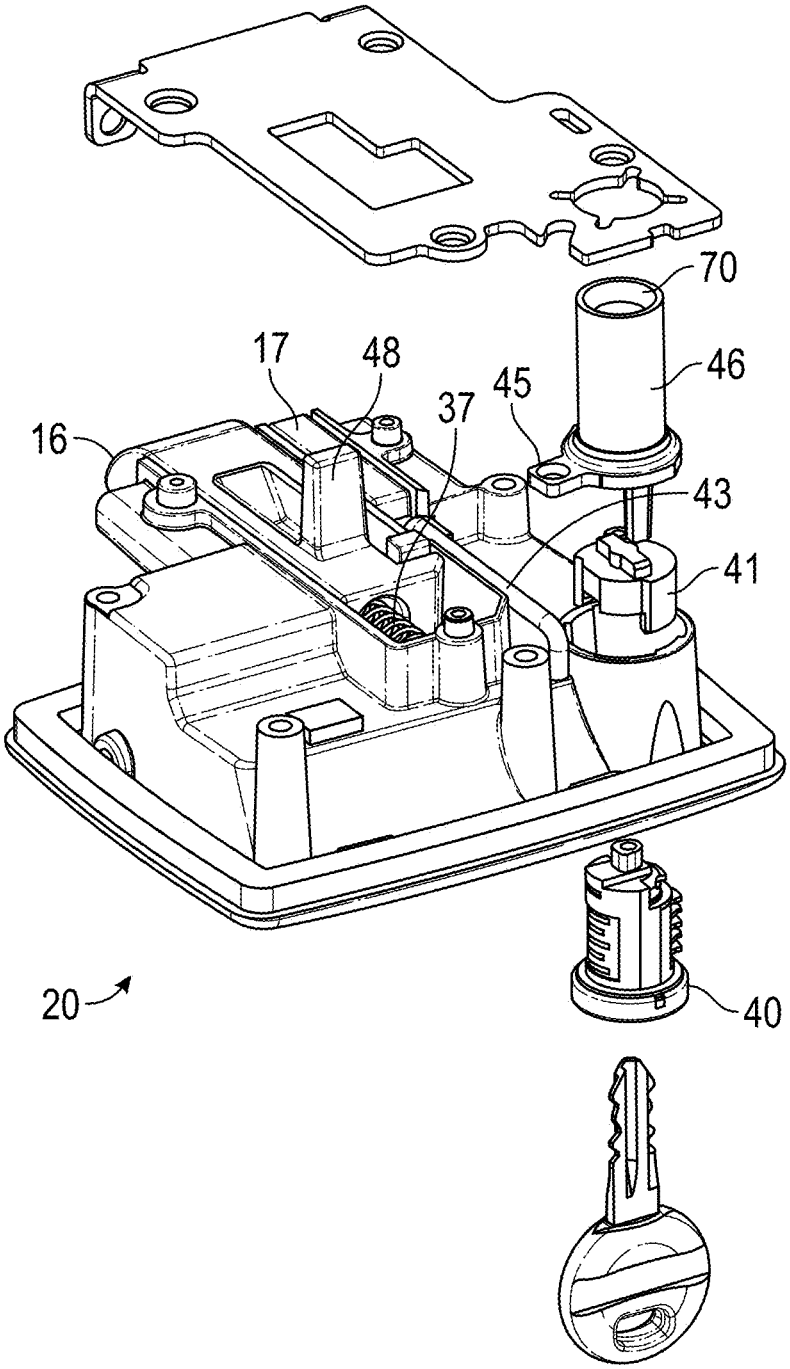
FIG. 18 is an exploded perspective view of the main door handle module.
Figure 19:
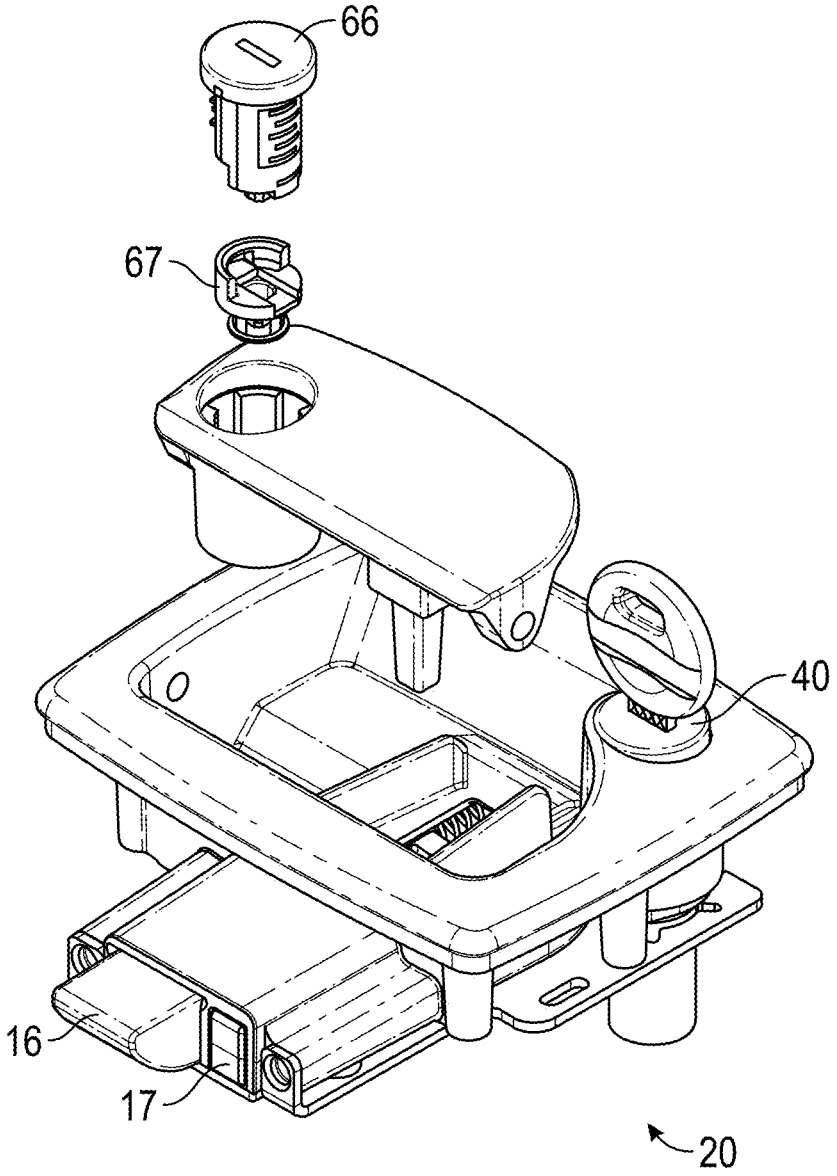
FIG. 19 is another exploded perspective view of the main door handle module.
Figure 20:
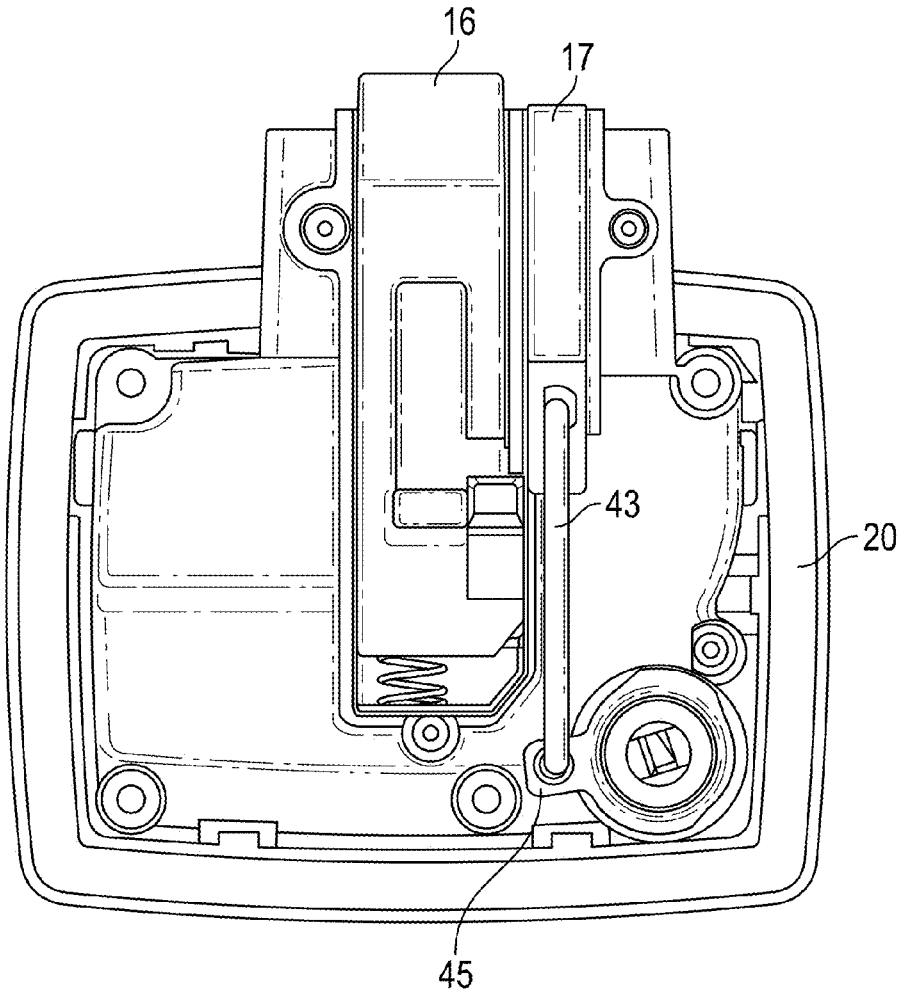
FIG. 20 is a plan view of the main door handle module with the inside cover plate removed to show the connecting rod between the deadbolt and the actuator.

The screen door module 14 exterior handle assembly 28 includes a compression spring 36 and a guide post 38 to control movement of the screen door plunger 18, as best seen in FIGS. 16 and 17. The spring 36 biases the screen door plunger 18 to an extended position. The post 38 is received in a guide slot 39 in the screen door plunger, such that the plunger slides between the extended and retracted positions. The main door plunger 16 is also biased to an extended position by a spring 37 in the main door module 12, as seen in FIG. 11A.

Figure 11D:
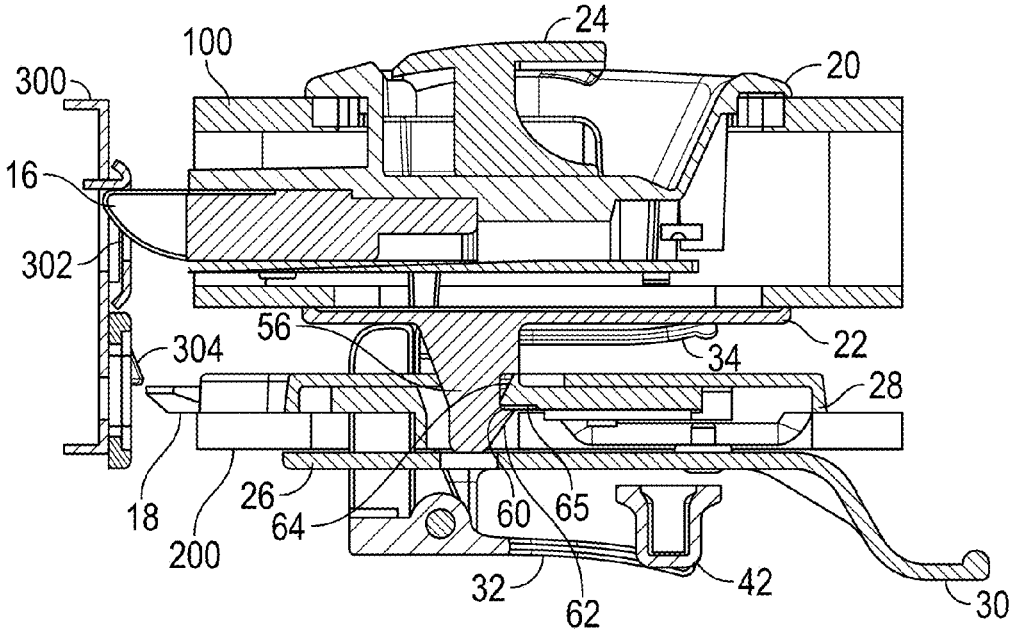
FIG. 11D is a sectional view taken along liens 11D-11D of FIG. 4 showing the screen door module connection to the main door module.
Figure 11E:
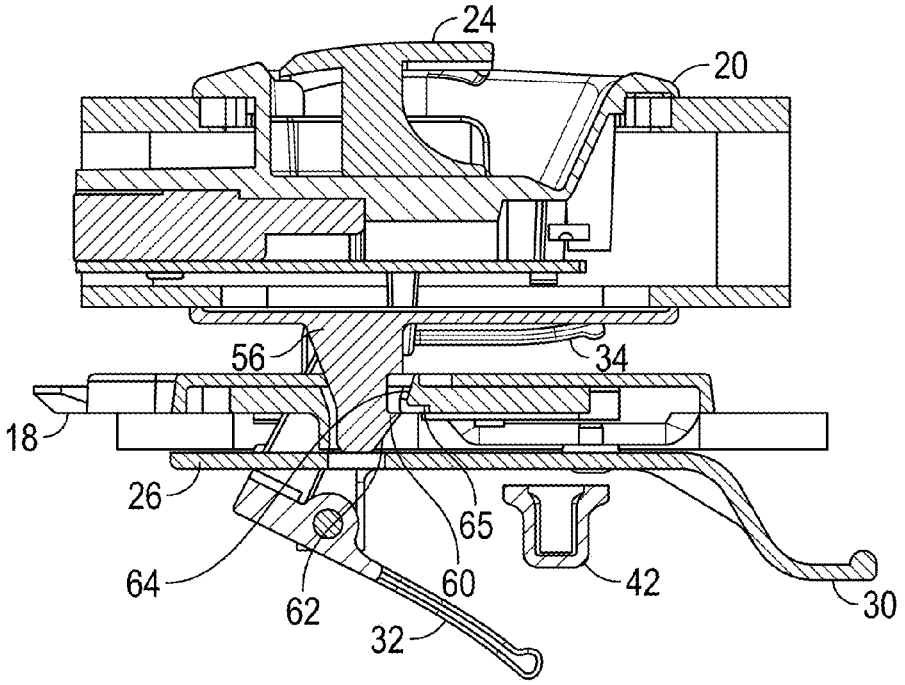
FIG. 11E is a view similar to FIG. 11D showing the interior screen door handle pulled to retract the plunger on the screen door module to allow the doors to be separated.
Figure 11F:
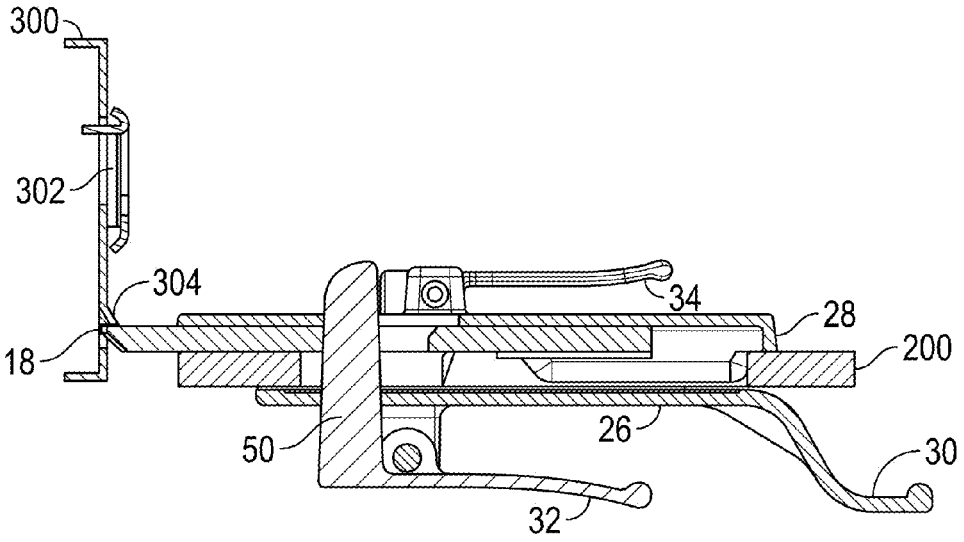
FIG. 11F is a view similar to FIG. 11B but with the main door opened and the screen door latched.
Figure 11G:
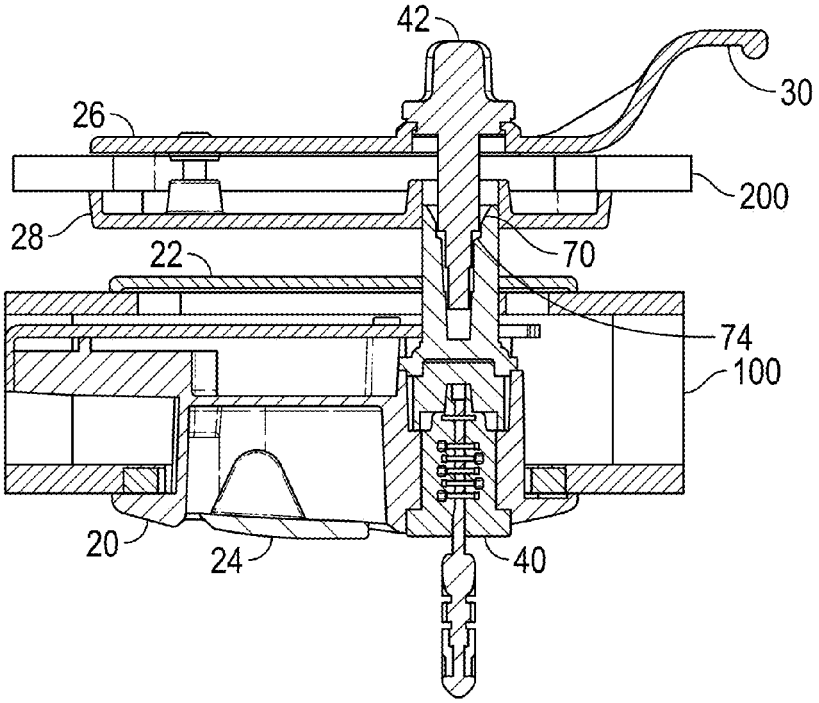
FIG. 11G is a sectional view of the integrated handle assembly taken along lines 11G-11G of FIG. 4.

When the main door 100 is open and the screen door 200 is closed, pulling the exterior screen door handle 34 on the screen door module 14 will retract the screen door plunger 18 via a leg 52 on the handle 34, which extends through a clearance hole 54 in the screen door exterior handle assembly 28 to engage a portion 68 of the screen door plunger 18. See FIGS. 15 and 17. The screen door 200 can be selectively coupled to the main door 100 by a retention post 56 on the main door cover plate 22 of the main door module 12. The top nose 62 of the retention post 56 frictionally engages a contact nose 64 (FIGS. 12 and 15) of the screen door plunger 18 through a clearance hole 58 in the screen door exterior handle assembly 28 of the screen door module 14. The post 56 has a small notch forming a catch ledge 60 to releasably engage an edge 65 of the screen door plunger 18, as seen in FIGS. 11D and 11E. When the doors 100, 200 are coupled, the catch 60 partially retracts the screen door plunger 18. The interior screen door handle 32 can be pulled to fully retract the screen door plunger 18 and disengage the catch 60 to a plunger edge 68 (FIG. 17), such the doors 100, 200 can be separated. Then, the main door 100 can be left open while the screen door 200 is closed. Since the catch 60 is disengaged from the screen door plunger 18, the plunger 18 will be fully extended to engage the screen door frame tab 304 and hold the screen door shut, as seen in FIG. 11F. Actuation of either handle 32, 34 will retract the screen door plunger 18 for opening the screen door 200.

Figure 12:
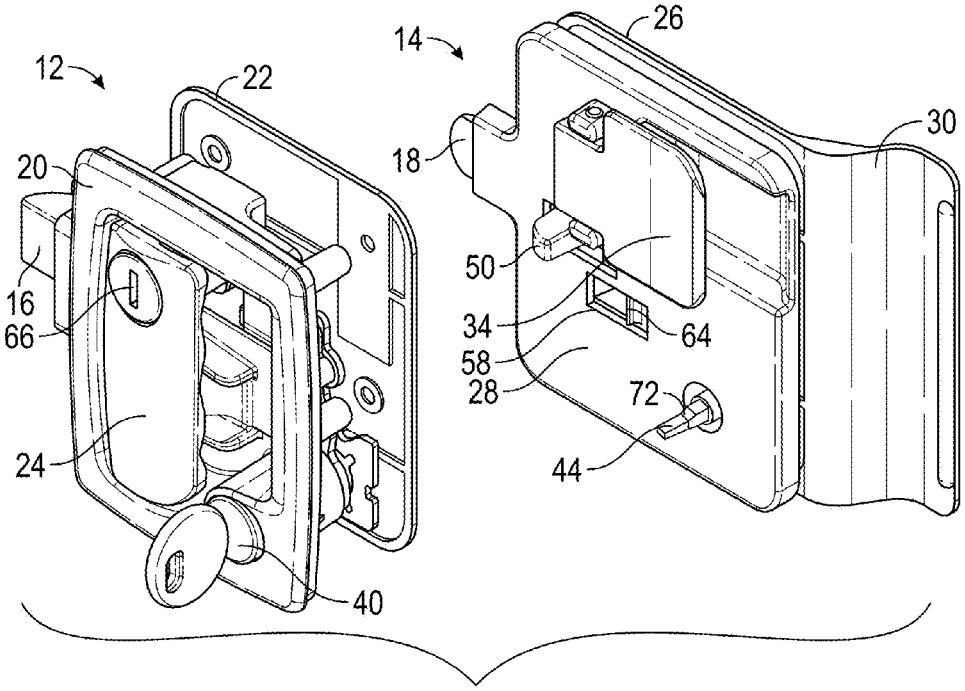
FIG. 12 is an exploded perspective view of the main door and screen door modules from the outside face of the RV or Trailer.
Figure 13:
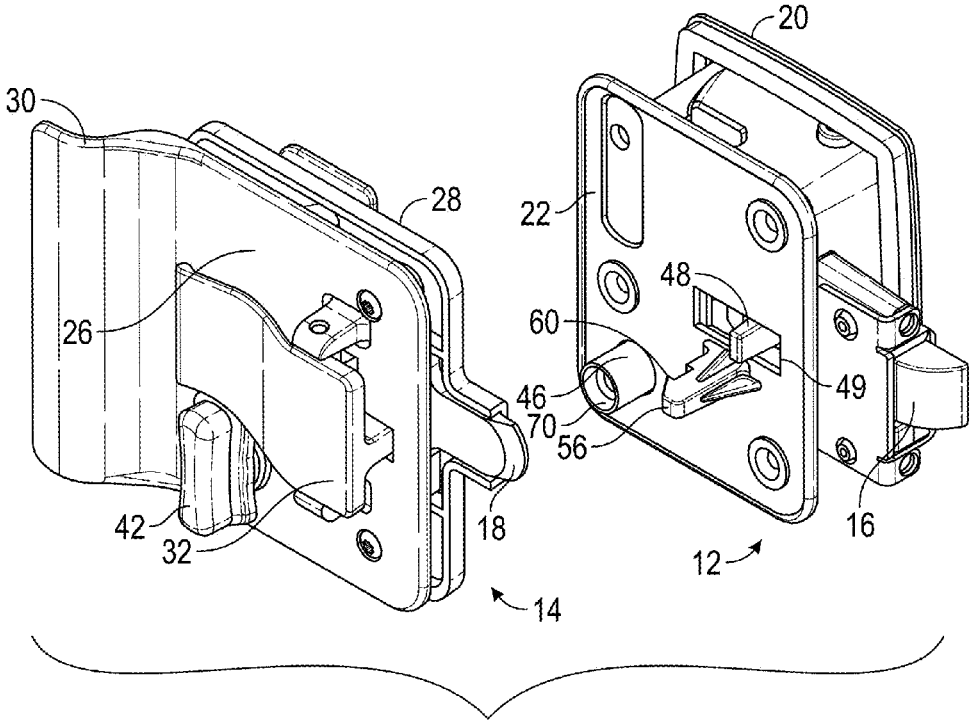
FIG. 13 is another exploded perspective view of the screen door and main door modules from the inside face of the RV or Trailer.
Figure 14:
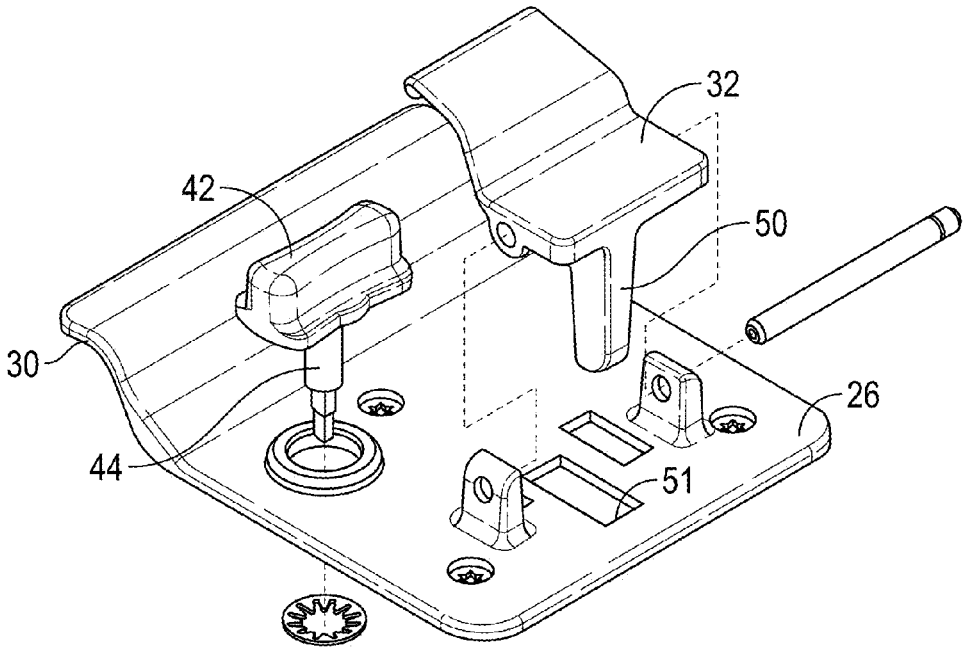
FIG. 14 is an exploded perspective view of the inside handle assembly of the screen door module.

A key lock cylinder 40 is mounted on the main door module 12 for locking and unlocking the deadbolt 17 of the integrated handle assembly 10 from outside the RV or trailer. A rotatable knob 42 on the screen door module 14 is operatively connected to the lock cylinder 40 so as to lock and unlock the deadbolt 17 of the integrated handle assembly 10 from inside the RV or trailer. A male and female connection 44, 46 provides a preferred coupling between the lock cylinder 40 and the interior screen door lock knob 42. More particularly, the post 44 on the lock knob 42 is received on the receiver 46 of the main door lock actuator 41, as best seen in FIGS. 12 and 13, when the handle modules 12, 14 are coupled. An angled lead-in 70 on the female lock connection 46 allows a guide for the male post of the lock knob 42. The curved surface 72 of the lock knob 42 guides the lock knob 42 into the correct orientation as is contacts surface 74 of the female lock connection 46. A rod 43 connects the deadbolt 17 to a tab 45 on the receiver 46, such that turning of the knob 42 extends and retracts the deadbolt 17 when the handle modules are coupled.

A key lock cylinder 66 and actuator 67 are mounted on the main door module 12 for locking and unlocking the exterior handle 24 of the main door handle assembly 20. When key lock cylinder 66 is rotated by a key to the locked position, the exterior handle 24 is locked rigid, preventing the main door handle assembly 20 from opening the integrated handle assembly 10 from outside the RV or trailer.

Thus, the integrated handle assembly 10 of the present invention provides a simplified structure for opening the main door and screen door of an RV or trailer when the doors are connected together for simultaneous movement or when the doors are disconnected for independent movement between open and closed positions. The integrated handle assembly 10 also eliminates the conventional sliding screen door panel, since the screen door module 14 includes interior and exterior handles 32, 34. The handle modules 12, 14 can be coupled and decoupled so as to couple and decouple the main and screen doors.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved handle assembly for an outer main door and an inner screen door pivotally mounted in a door frame, the doors swinging outwardly to open and inwardly to close, comprising:

a first module mounted on the outer main door and having a first plunger;

a second module mounted on the inner screen door and having a second plunger;

a pull handle on the second module operatively connected to the first and second plungers to retract the first and second plungers when the handle is pulled inwardly from inside the inner screen door when the doors are both closed to allow the doors to swing outwardly open; and the second module including a second pull handle to open the inner screen door when the second pull handle is pulled outwardly from outside the inner screen door when the outer main door is open.

2. The improved handle assembly of claim 1 wherein the pull handle is on the inside of the inner screen door.

3. The improved handle assembly of claim 1 wherein the first and second modules are releasably coupled together when both doors are closed and decoupled when the outer main door is open and the inner screen door is closed.

4. The improved handle assembly of claim 1 wherein the second handle includes a leg engaging the second plunger to retract the second plunger when the second handle is pulled.

5. The improved handle assembly of claim 1 wherein the pull handle on the second module is a paddle with a leg engaging the first plunger.

6. The improved handle assembly of claim 5 wherein the first plunger includes a leg extending out of the first module for engagement by the leg of the pull handle on the second module.

7. The improved handle assembly of claim 1 wherein the first module has a catch to retentively and releasably engage the second module to couple the modules together.

8. The improved handle assembly of claim 7 wherein the catch engages the second plunger.

9. A handle assembly for an outer main door and an inner screen door which can be opened outwardly and closed inwardly together or separately, comprising:

a main door handle module mounted on the outer main door;

a screen door handle module mounted on the inner screen door;

an elongated deadbolt slidably mounted on the main door handle module and being longitudinally extensible out of and retractable into the outer main door;

a knob on the screen door handle module operatively connected to the deadbolt to extend and retract the deadbolt out of and in to the outer main door;

the handle modules being coupled when the doors move together and being de-coupled when the doors move separately, and;

the main door handle module including a lock cylinder connected to the deadbolt and the knob including a post operatively connected to the lock cylinder when the modules are coupled and disconnected from the lock cylinder when the modules are de-coupled.

10. The handle assembly of claim 9 wherein the post extends from the screen door handle module and into the main door handle module when the modules are coupled.

* * * * *